US006255999B1

(12) United States Patent
Faulkner et al.

(10) Patent No.: US 6,255,999 B1
(45) Date of Patent: Jul. 3, 2001

(54) ANTENNA ELEMENT HAVING A ZIG ZAG PATTERN

(75) Inventors: Scott Anthony Faulkner, Harrisburg, PA (US); Lawrence Steven Gans, Exeter, NH (US); Supriyo Dey, Burlington, MA (US)

(73) Assignee: The Whitaker Corporation, Wilmington, DE (US)

( * ) Notice: Subject to any disclaimer, the term of this patent is extended or adjusted under 35 U.S.C. 154(b) by 0 days.

(21) Appl. No.: 09/417,250

(22) Filed: Oct. 13, 1999

Related U.S. Application Data

(60) Provisional application No. 60/131,375, filed on Apr. 28, 1999, and provisional application No. 60/131,376, filed on Apr. 28, 1999.

(51) Int. Cl.[7] ..... H01Q 1/36

(52) U.S. Cl. ..... 343/895; 343/749; 343/702

(58) Field of Search ..... 343/702, 745, 343/749, 895, 750; H01Q 1/24, 1/36

(56) References Cited

U.S. PATENT DOCUMENTS

| | | | | |
|---|---|---|---|---|
| 3,656,168 | * | 4/1972 | Stropki | 343/895 |
| 4,598,276 | * | 7/1986 | Tait | 343/572 |
| 5,363,114 | | 11/1994 | Shoemaker | 343/828 |
| 5,559,524 | * | 9/1996 | Takei et al. | 343/895 |
| 5,668,559 | | 9/1997 | Baro | 343/702 |
| 5,724,717 | * | 3/1998 | Gherardini | 29/600 |
| 5,807,123 | | 9/1998 | Spiegelaar et al. | 439/188 |
| 6,028,567 | * | 2/2000 | Lahti | 343/895 |
| 6,040,803 | * | 3/2000 | Spall | 343/700 MS |
| 6,061,036 | | 5/2000 | MacDonald, Jr. et al. | 343/873 |

FOREIGN PATENT DOCUMENTS

| | | | |
|---|---|---|---|
| 198 58 090 A1 | 6/1999 | (DE) | H01Q/5/01 |
| WO 96/38879 | 12/1996 | (WO) | H01Q/9/30 |
| WO 97/49141 | 12/1997 | (WO) | H01Q/1/36 |
| WO 98/28814 | 7/1998 | (WO) | H01Q/1/24 |

OTHER PUBLICATIONS

Abstract & Drawings Only, U.S. Patent Application No. 09/206,445, filed Dec. 7, 1998.

* cited by examiner

*Primary Examiner*—Hoanganh Le
*Assistant Examiner*—Trinh Vo Dinh

(57) ABSTRACT

An antenna element (1) includes, a film (10) of dielectric material having thereon a radiating antenna element (14) that radiates at a first order harmonic frequency within a desired first frequency band, a conducting capacitive load element (90) and the radiating antenna element (14) being capacitively coupled across a thickness of the film (10) at a second order harmonic frequency, to tune a radiated second order harmonic frequency to correspond with a desired second frequency band, thereby providing a dual band antenna element (1).

13 Claims, 4 Drawing Sheets

ANTENNA ELEMENT HAVING A ZIG ZAG PATTERN

This application claims the benefit of U.S. Provisional Application Nos. 60/131,375, and 60/131,376 filed Apr. 28, 1999.

FIELD OF THE INVENTION

The present invention relates to an antenna, and, more particularly, to an antenna for a personal communications device.

BACKGROUND OF THE INVENTION

A dual band antenna disclosed in U.S. patent application Ser. No. 09/206,445, has a coil antenna element with a first winding at a feed point, and a second winding at a far end of the antenna. A reactive or parasitic antenna element is provided on a film that forms a wrapping over the coil. The film provides a thin dielectric between the coil and the reactive element, which capacitively couples the coil and the reactive element. At lower frequencies, the reactive element is electrically inactive, while at higher frequencies, the element establishes a short circuit.

SUMMARY OF THE INVENTION

It is desired to provide an antenna element that has a simplified assembly procedure and tuning procedure, and is less sensitive to manufacturing tolerances than a coil antenna element.

It is desired to provide a capacitive load element that is easily and accurately positionable in relationship to a radiating antenna element to couple to the radiating antenna element.

It is desired to provide an antenna element for a dual band antenna.

It is desired to provide an antenna element having a radiating antenna element and a capacitive load element that is capacitively coupled to the radiating antenna element to provide a dual band antenna element.

It is desired to provide an antenna element that has a film on which a radiating antenna element and a capacitive load element are capacitively coupled to provide a dual band antenna element.

The present invention provides an antenna element having a radiating element on a film of dielectric material, the dielectric material having thereon a capacitive load element, the radiating antenna element and the capacitive load element being capacitively coupled across a thickness of the film with the film having the radiating element thereon being formed into a sleeve shape, and the radiating antenna element and the capacitive load element capacitively couple to provide a dual frequency band antenna element.

DESCRIPTION OF THE DRAWINGS

Embodiments of the invention will now be described by way of example, with reference to the accompanying drawings, according to which.

DETAILED DESCRIPTION

Figure 4:
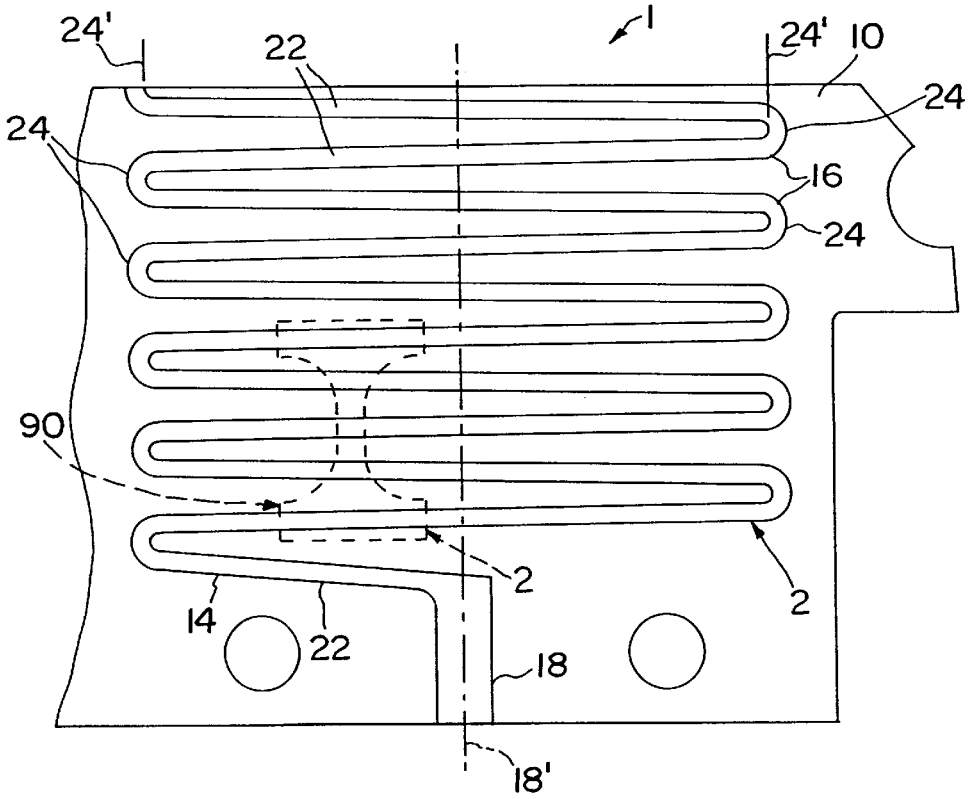
FIG. 4 is an enlarged top view of a radiating antenna element and a feed line on a film, and a capacitive load element shown in phantom outline.

The invention will now be described with similar features among the various embodiments being referenced with the same numerals. With more particular reference to FIGS. 9 and 11, an antenna element 1 comprises a film 10, also referred to as a film element, of dielectric material having thereon a radiating antenna element 14, also referred to as a trace. With reference to FIG. 4, the film 10 has thereon a capacitive load element 90, also referred to as a parasitic trace, that are capacitively coupled to provide a dual band antenna element 1.

The radiating antenna element 14 is connected with a unitary antenna feed line 18, also referred to as a tail portion, extending from an edge of the film 10. The radiating antenna element 14 has multiple straight radiating elements 22, also referred to as arms, that intersect one to another at respective angles, and that are connected one to another electrically in series and in reverse directions of current flow along a reversing zig zag pattern 16, also referred to as a zig zag portion. The radiating elements 22 intersect one to another at sharply angled corners 24 along the reversing zig zag pattern 16.

For example, the radiating antenna element 14 has the following dimensions. Each straight radiating element 22 has a conducting transmission line width of 0.50 mm. that is also the conducting width of each of the corners 24. The feed line 18 has a center axis 18' that intersects the midpoint of each of the straight radiating elements 22. The inside edges of the corners 24 are along lines 24' that are 17 mm. apart, the lines 24' being parallel to the axis 18' of the feed line 18. Each of the corners 24 has an inside radius of 0.26 mm. and an outside radius of 0.76 mm., with a common center of radius. The centers of radius, which correspond to successive corners 24, are on respective transverse axes that are spaced at increments of 1.25 mm. along the axis of the feed line 18. The corners 24, being positioned as described, determine the angles at which the straight radiating elements 22 intersect one to another.

Figure 5:
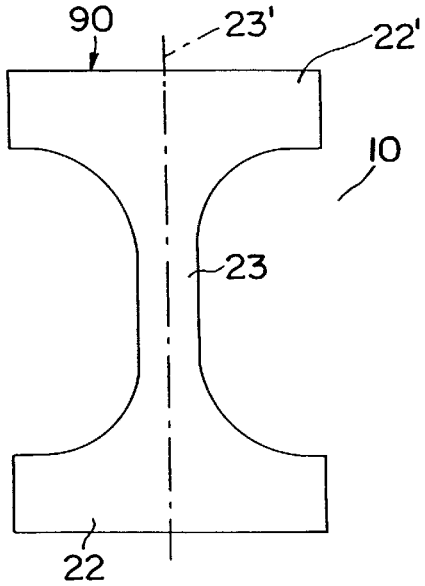
FIG. 5 is an enlarged top view of a capacitive load element on a portion of a film.

With reference to FIG. 5, the capacitive load element 90 is of unitary construction, and has a pair of straight conducting load elements 22', also referred to as first and second ends, interconnected by a transmission line 23 along a center axis 23' interconnecting the load elements 22' at their midpoints. The axes 23', 18' are parallel. With further reference to FIG. 4, the radiating antenna element 14 and the capacitive load element 90 are superposed, with the transmission line 23 of the capacitive load element 90 being parallel to the axis 18' of the feed line 18. Further, the load elements 22' of the capacitive load element 90 are parallel with and are superposed with respective straight radiating elements 22 of the radiating antenna element 14 that conduct current in reverse directions along the zig zag pattern 16.

Figure 11:
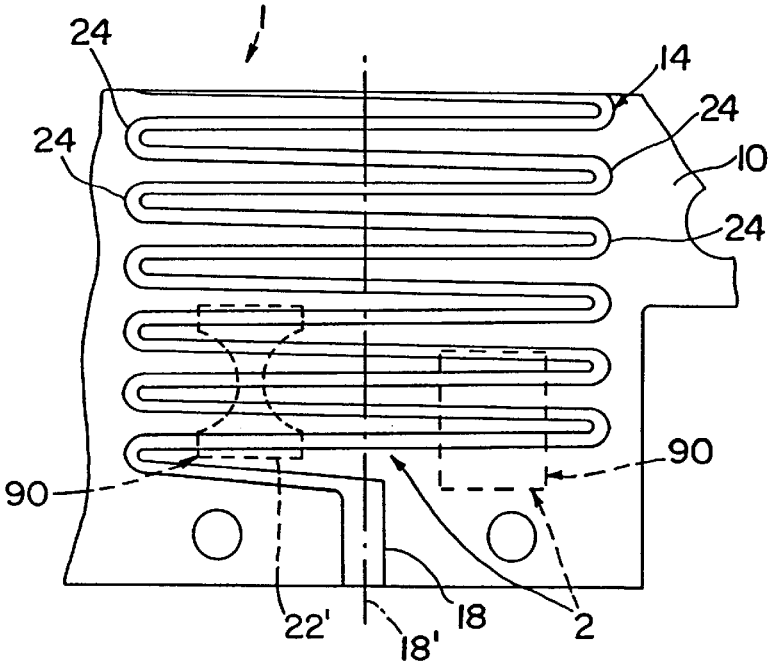
FIG. 11 is a plan view of another embodiment of an antenna element.

According to an embodiment, as shown further with reference to FIG. 4, the radiating antenna element 14 and the capacitive load element 90 are on opposite sides of the film 10. According to another embodiment as shown in FIG. 11, the radiating antenna element 14 and the capacitive load element 90 are on the same side of the film 10. The center axes 18' and 23' of the two elements 14, 90 are spaced apart πD, where D is the diameter of the sleeve of the sleeve shape. The embodiment of a capacitive load element 90, shown in FIG. 12 on the same side of the film 10 as the radiating antenna element 14, is a mirror image of an embodiment of the capacitive load element 90, of the same shape, that would be provided on an opposite side of the film 10 from the radiating antenna element 14.

According to the embodiment shown in FIG. 11, the radiating antenna element 14 and the capacitive load element 90 are superposed, for example, by having the film 10 being rolled to a cylindrical sleeve shape, with the film 10 overlapping itself to superpose the antenna elements 14 and 90, with their center axes 23', 18' aligned. The capacitive load element 90 is positioned to face a side of the film 10 that is opposite to the side of the film 10 having thereon the radiating antenna element 14, such that the radiating antenna element 14 and the capacitive load element 90 are capacitively coupled across the thickness of the film 10. Further, the film 10 in a sleeve shape aligns the capacitive load elements 22' of the capacitive load element 90 parallel with, and superposed with, respective straight radiating elements 22 of the radiating antenna element 14 that conduct current in reverse directions along the zig zag pattern 16.

For example, the capacitive load element 90, FIG. 5, has the following dimensions. The transmission line 23 has a width of 0.75 mm. The overall length of the capacitive load element 90 axially along the transmission line 23 is 6 mm. The load elements 22 are along an angle of 0°–30°. Each of the load elements 22 join the transmission line with a radius of 1.5 mm., at one rounded corner, and a radius of 1.2 mm. at a second rounded corner. The opposite ends of the load elements 22 are each 1 mm. wide.

Figure 13:
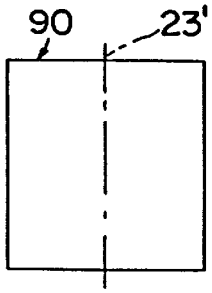
FIG. 13 is a planar development of a capacitive load element of the embodiment as shown in FIG. 11.

Another embodiment is shown further with reference to FIGS. 11 and 13. With reference to FIG. 13, the capacitive load element 90 is of unitary construction, and has a rectangular shape, 3.75 mm. width and 5 mm. vertical length. FIG. 11 illustrates the radiating antenna element 14 and the capacitive load element 90 in desired superposed positions. The radiating antenna element 14 and the capacitive load element 90 are separated by a thickness of the film 10, which provides capacitive coupling, also referred to as parasitic coupling and as reactive coupling, of the capacitive load element 90 and the radiating antenna element 14 across the thickness of the film 10.

For the embodiment of FIG. 11, the film 10 is rolled into a sleeve shape that has an axis of a cylinder that is parallel to the axis 18' of the feed line 18.

The reversing current flows, along the angles of the radiating elements 22 of each radiating antenna element 14 are resolved into horizontal and vertical vector components. The horizontal components tend to cancel, due to current flows in opposing directions. The radiated signal is vertically polarized, as the sum of the vertical components.

The sharply angled corners 24 are free of pointed corners to provide smooth phase reversals without significant propagate delays of current propagating along the reversing zig zag pattern, and to minimize voltage standing wave reflections of significance, which increases the gain of the signal being propagated.

Each of FIGS. 4 and 11 illustrates the radiating antenna element 14 and the capacitive load element 90 in desired superposed positions. The radiating antenna element 14 and the capacitive load element 90 are separated by a thickness of the film 10, which provides capacitive coupling, also referred to as parasitic coupling and as reactive coupling, of the capacitive load element 90 and the radiating antenna element 14 across the thickness of the film 10.

The radiating antenna element 14 radiates a microwave signal of first order harmonic frequency within a desired lower frequency band, with each of the radiating elements 22 being of a length which resonates at the first order harmonic frequency. The radiating antenna element 14 further tends to radiate at a second order harmonic frequency. However, at the second order harmonic frequency, the conducting load elements 22' of the capacitive load element 90, capacitively couple to the respective radiating elements 22 of the radiating antenna element 14, applying a capacitive load that tunes the radiated second order harmonic frequency with a broad frequency band that corresponds to a desired, second frequency band of microwave signals. Thus, a dual band antenna element 1 is provided by having the radiating antenna element 14 radiate a signal at a fixed first frequency comprising, the first order harmonic frequency that is within a desired first frequency band for communications signals, and having the radiating antenna element 14 being capacitively coupled with the capacitive load element 90 at a second order harmonic frequency that adjusts the characteristic impedance closer to 50 Ohms, which tunes the antenna element 14 to radiate at a broadened band of second order harmonic frequencies that are within a second frequency band for communications signals. Thus, the antenna element 1 becomes a dual band antenna element that operates within two frequency bands for communications signals, for example, cellular telephone frequency bands, and other frequency bands for PCS communications.

The sleeve shape, which was discussed in conjunction with the embodiment shown in FIG. 11, further provides the radiating elements 22 with curvature. The embodiment of FIG. 4 is usable with the film 10 and the elements 14 and 90 being either flat or with the film 10 having the radiating antenna element 14 and the capacitive load element 90 thereon, being rolled to a sleeve shape to provide the radiating elements 22 with curvature. In either shape, the radiating antenna element 14 radiates a signal nearly linearly polarized, but not perfectly linearly polarized, because, advantageously, the signal has relatively high cross polarization (90° from linear), which provides a desired radiation pattern.

Figure 3:
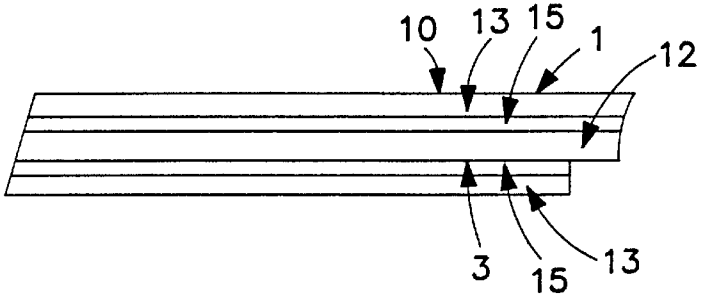
FIG. 3 is an enlarged fragmentary view of a portion of the film, as shown in FIG. 1.
Figure 12:
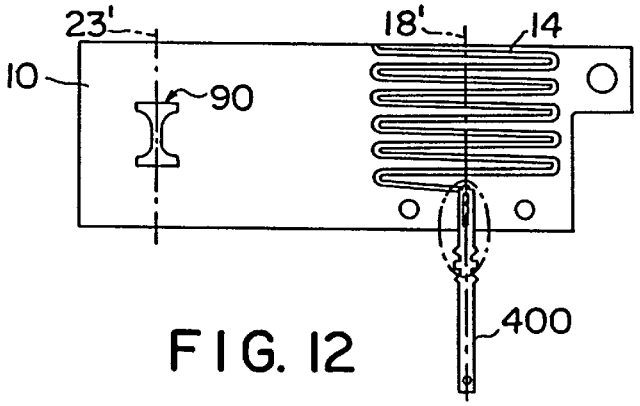
FIG. 12 is a plan view of another embodiment of an antenna element.

With reference to FIG. 3, manufacture of the antenna element 1 will now be described with reference to the embodiment of FIG. 4, with an understanding that each of the embodiments of FIG. 4, FIG. 11 and FIG. 12, are manufactured similarly. Accordingly, to continue the description, the film 10 has a dielectric layer 12 covered by laminates of conducting layers 13 attached with respective layers of adhesive 15. For example, the dielectric layer 12 is 0.05 mm. thick. The dielectric layer 12 has a thickness that allows the dielectric layer 12 to be flexible, together with the layers 13 and adhesive 15. Each of the layers of adhesive 15 is 0.025 mm. thick. Each of the conducting layers 13 is 0.035 mm. thick. The conducting layers 13 are subjected to a subtractive process, for example, a photoetching process, according to which process, selected portions of both the conducting layers 13, and the layers of adhesive 15, are removed, and thereby subtracted, to leave the radiating antenna element 14 and the load element 90 on the film 10. For example, the layers 13 are subjected to masking, photoexposure and photodevelopment, followed by fluid etchants that remove the photodeveloped, selected portions by an etching process.

Manufacture of the antenna element 1 is alternatively provided by an additive process, according to which the dielectric layer 12 is subjected to electroless plating process, followed by an electroplating process, to add metal plating to form the radiating antenna element 14 and the load element 90 on the dielectric layer 12. For example, the plating is applied with fluid electrolytes of the metals to be added by the plating operations. Because fluids of etchants or plating electrolytes are used, the surface tensions of the fluids tend to form the fluid with smooth droplet edges, which assist in avoiding the formation of pointed edges on the corners 24.

The radiating antenna elements 14 and the capacitive loading element 90 are manufactured with precise, repeatable dimensions that are easily replicated. The elements 14, 90 remain unchanged in shape in response to vibration, temperature changes, impact and with the passage of time. By comparison, coiled wire monopole antenna elements have less precisely controlled dimensions and undergo changes in shape in response to vibration, temperature changes, impact and with the passage of time.

Figure 1:
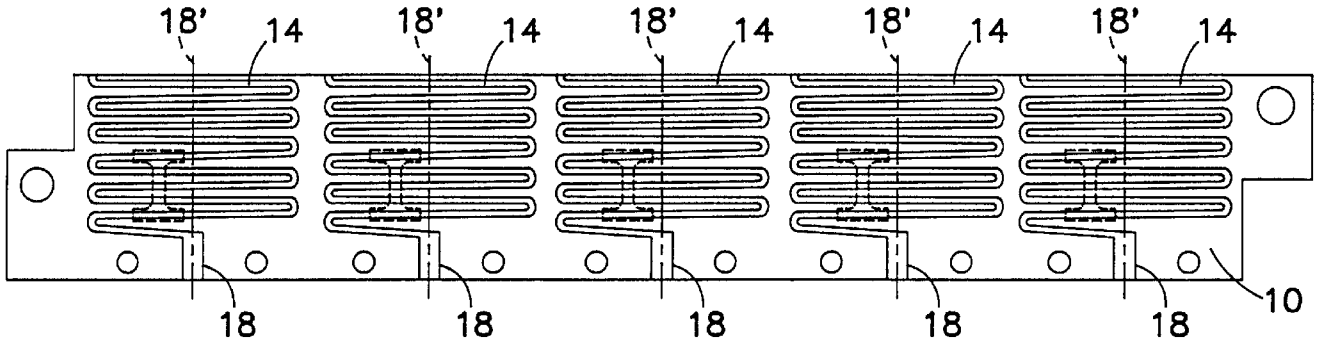
FIG. 1 is a top view of five radiating antenna elements on a film of insulating material.
Figure 2:
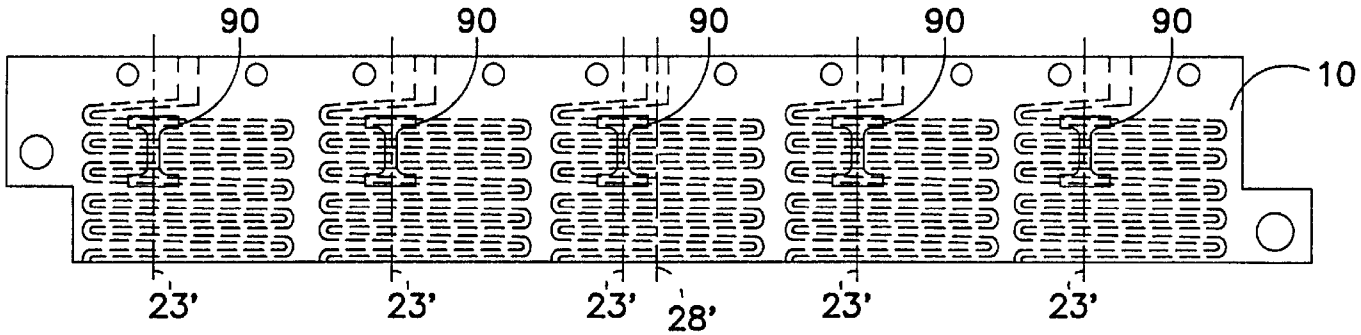
FIG. 2 is a top view of five capacitive load elements on the film, as shown in FIG. 1.
Figure 9:
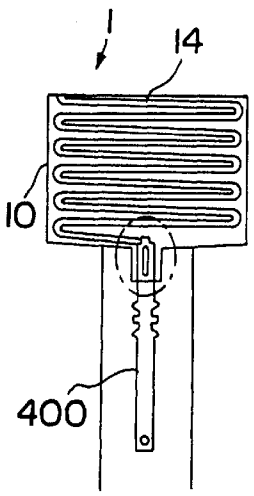
FIG. 9 is a plan view of an antenna element having a radiating antenna element and a contact connected to a feed line.
Figure 10:
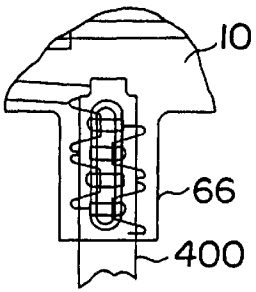
FIG. 10 is a fragmentary view of a reverse side of the contact connected to a feed line, as shown in FIG. 9.

With reference to FIGS. 1 and 2, multiple radiating antenna elements 14 and capacitive load elements 90 are provided along opposite sides of a strip of the insulating film 10. Contacts 400 are compression crimp connected on respective antenna feed lines. With reference to FIGS. 9, 10 and 11, the individual radiating elements 14 are cut out from the film 10 with a narrow leg 66 of the film supporting the antenna feed line 18 and the attached contact 400.

Figure 6:
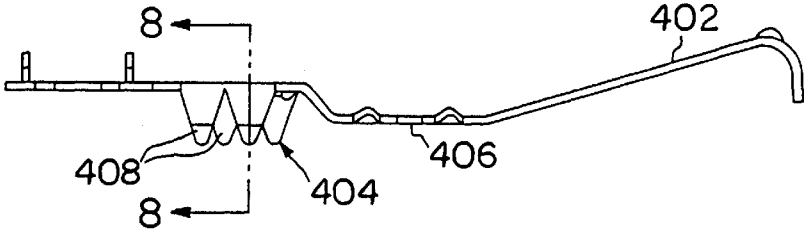
FIG. 6 is a side view of a contact for connection to the feed line, as shown in FIG. 4.
Figure 7:
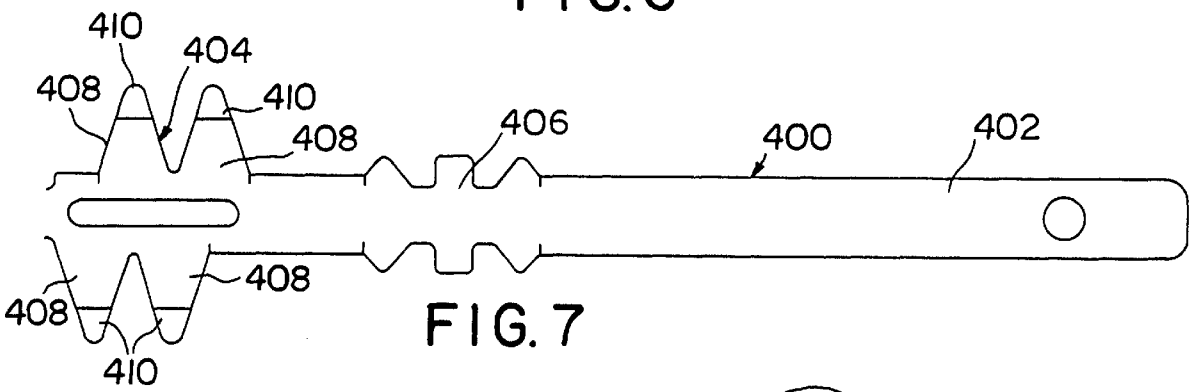
FIG. 7 is a view of a development of the contact as shown in FIG. 6.
Figure 8:
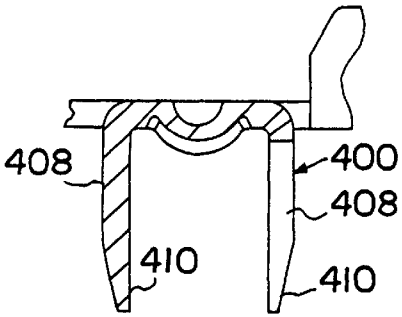
FIG. 8 is an enlarged section view of the contact as shown in FIG. 6.

With reference to FIGS. 6, 7 and 8, the contact 400 has a pin section 402 at one end for connection to external circuitry. A crimping section 404 extends from a body section 406 and includes arms 408 that penetrate the leg 66 of the film 10 and further, after penetrating the film 10, are bent over such that ends 410 of the arms 408 are pressed into the conductive antenna feed line 18, and pressing the film 10 and the feed line 18 against the body section 406, which mechanically and electrically connect the contact 400 and the radiating antenna element 14. The contact 400 is commercially available as Part No 88976-3 from AMP Incorporated, Harrisburg Pa., also known as Tycoelectronics.

Embodiments of the invention have been disclosed. Other embodiments and modifications of the invention are intended to be covered by the spirit and scope of the appended claims.

What is claimed is:

1. An antenna element comprising:

a film of dielectric material having thereon a radiating antenna element that radiates at a fixed, first order harmonic frequency within a desired first frequency band, the radiating antenna element radiating at a second order harmonic frequency, the film of dielectric material having thereon a conducting capacitive load element on the same side of the film as the radiating antenna element, the capacitive load element and the radiating antenna element being capacitively coupled across a thickness of the film at the second order harmonic frequency, with the film being rolled into a sleeve shape, to tune the radiating antenna element to the radiated second order harmonic frequency to correspond with a desired second frequency band, thereby providing a dual band antenna element.

2. An antenna element as recited in claim 1 wherein the radiating antenna element is connected to a conducting antenna feed line on the film, an electrical contact has a crimping section that is joined to the feed line, and the electrical contact has a pin section for connecting the electrical contact and the feed line to an external electrical circuit.

3. An antenna element as recited in claim 1 wherein the capacitive load element is rectangular.

4. An antenna element as recited in claim 1 wherein the capacitive load element has a transmission line interconnecting a pair of conducting load elements at their midportions.

5. An antenna element as recited in claim 1 wherein the radiating antenna element is a conducting trace, the trace having multiple radiating elements that intersect one to another at respective angles, and the multiple radiating elements are connected electrically in series and in reverse directions of current flow along a reversing zig zag pattern, and the capacitive load element has a transmission line interconnecting a pair of conducting load elements at their mid-portions.

6. An antenna element as recited in claim 5 wherein the pair of conducting load elements are parallel with, and are superposed with, respective radiating elements of the radiating antenna element.

7. An antenna element as recited in claim 1 wherein the radiating antenna element has multiple straight radiating elements that intersect one to another at respective angles, and that are connected one to another electrically in series and in reverse directions of current flow along a reversing zig zag pattern, and the capacitive load element has a transmission line interconnecting a pair of straight conducting load elements at their mid-portions.

8. An antenna element as recited in claim 7 wherein the radiating antenna element is connected to a conducting antenna feed line on the film, and an axis of the transmission line is parallel to an axis of the conducting antenna feed line.

9. An antenna element as recited in claim 7 wherein the pair of straight conducting load elements are parallel with, and are superposed with, respective straight radiating elements of the radiating antenna element.

10. An antenna element comprising:

a film of dielectric material having thereon a radiating antenna element that radiates at a fixed, first order harmonic frequency within a desired first frequency band, the radiating antenna element radiating at a second order harmonic frequency, the film of dielectric material having thereon a conducting capacitive load element on an opposite side of the film as the radiating antenna element, the capacitive load element and the radiating antenna element being capacitively coupled across a thickness of the film at the second order harmonic frequency, with the film being rolled into a sleeve shape, to tune the radiating antenna element to the radiated second order harmonic frequency to correspond with a desired second frequency band, thereby providing a dual band antenna element.

11. An antenna element as recited in claim 10 wherein the capacitive load element has a transmission line interconnecting a pair of conducting load elements at their midportions.

12. An antenna element as recited in claim 10 wherein the capacitive load element has a transmission line interconnecting a pair of conducting load elements at their midportions, and the load elements are parallel with, and are superposed with, respective radiating elements of the radiating antenna element.

13. An antenna element as recited in claim 10 wherein the capacitive load element is rectangular.

* * * * *